US011655580B2

(12) United States Patent
Rangu et al.

(10) Patent No.: US 11,655,580 B2
(45) Date of Patent: May 23, 2023

(54) WASHER APPLIANCE WITH REMOVABLE AGITATOR POST HAVING TWIST LOCK MECHANISM

(71) Applicant: Haier US Appliance Solutions, Inc., Wilmington, DE (US)

(72) Inventors: Venkata Chakradhar Rangu, Hyderabad (IN); Kalyana Mallavarapu, Hyderabad (IN); Neelapala Gopinath Yadav, Hyderabad (IN); Veera Venkata Anil Bhaskar Prasad Seereddy, Hyderabad (IN); Srikanth Gopireddy, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/365,384

(22) Filed: Jul. 1, 2021

(65) Prior Publication Data

US 2023/0002949 A1 Jan. 5, 2023

(51) Int. Cl.
*D06F 37/24* (2006.01)
*D06F 23/04* (2006.01)

(52) U.S. Cl.
CPC ..... *D06F 37/24* (2013.01); *D06F 23/04* (2013.01)

(58) Field of Classification Search
None
See application file for complete search history.

(56) References Cited

U.S. PATENT DOCUMENTS

| | | | | |
|---|---|---|---|---|
| 4,077,239 | A * | 3/1978 | Platt | D06F 13/02 68/184 |
| 10,787,761 | B2 | 9/2020 | Czarnecki | |
| 2004/0016267 | A1* | 1/2004 | Clark | D06F 13/02 68/133 |
| 2019/0062978 | A1* | 2/2019 | Czarnecki | D06F 34/28 |

FOREIGN PATENT DOCUMENTS

| | | |
|---|---|---|
| CN | 203729101 U | 7/2014 |
| CN | 204898347 U | 12/2015 |

* cited by examiner

*Primary Examiner* — Cristi J Tate-Sims
(74) *Attorney, Agent, or Firm* — Dority & Manning, P.A.

(57) ABSTRACT

A washer appliance with a removable agitator post includes an impeller supporting a receptable having multiple features for receipt of agitator tabs to secure or release the agitator post. A biasing element may be used to help secure or release the agitator post. The agitator post is rotated to secure or release it from the impeller. A removable cap may be included.

18 Claims, 14 Drawing Sheets

WASHER APPLIANCE WITH REMOVABLE AGITATOR POST HAVING TWIST LOCK MECHANISM

FIELD OF THE INVENTION

The subject matter of the present disclosure relates generally to a washer appliance having a removable agitator post.

BACKGROUND OF THE INVENTION

Washing appliances (also referred to as "washing machines") typically include a drum or basket for receipt of articles to be washed. Top-load or vertical axis washing machines rotate the drum about the vertical axis at various points during the cleaning cycle. Various components provide for adding fluid into the drum and for imparting motion to the fluid and articles being washed in order to clean the articles.

Conventionally, the washing appliance may include a knob or other switch by which the user selects the level of fluid in the vertical axis washing machine based on e.g., the load size of articles being washed. The user visually determines the desired fluid level based on the anticipated load size. Many washing appliance users are also accustomed to seeing a conventional agitator in the form of a post extending up from the bottom of the wash basket and configured to impart motion to the fluid and articles during the cleaning cycles. Users may associate factors such as fluid level and movement of the agitator as directly related to the effective cleaning of the articles and may believe that increased fluids levels and agitator action are advantageous.

Certain articles may require more wash space within the wash drum. For example, large garments, pillows, comforters and the like may require more volume for washing than typical articles of clothing. Sufficient space is required in order for the washing appliance to be able to impart motion to the articles and wash fluid as part of the cleaning process. Conventional agitator designs having a post that extends into the wash basket necessarily consume at least part of this space. In addition, in such designs the agitator is typically not designed for removal by the user of the appliance.

Improvements in technology and increasing water conservation requirements have resulted in washing appliances that can use less water during the cleaning cycle and may use features other than the conventional post-type agitator for imparting the desired movement of the articles within the wash basket or wash drum. For example, rotatable impellers have been developed that can impart the desired movement while consuming less volume inside the wash drum than the conventional agitator. Some washing appliances utilizing such designs may also be able to use less water during the cleaning cycle as well.

However, user perception of washing machine features that provide for the best cleaning experience may contradict the actual impact of such features. As previously mentioned, consumers familiar with a conventional post-type agitator extending vertically from the bottom of the wash drum may be reluctant to purchase or use a vertical-axis washing appliance lacking such feature. Yet, depending on the particular design employed, an impeller located at the bottom of the wash drum may have more impact in creating the desired agitation and cleaning of articles than the conventional agitator—including under conditions of less water usage.

And for larger loads or loads with larger articles, the space consumed by the conventional post-type agitator is needed for the articles.

Accordingly, a washing appliance with a removable agitator would be useful. More particularly, a washing appliance that allows the user to readily install or remove an agitator while still providing for effective cleaning of articles would be beneficial. Such as washing appliance that can allow of the installation or removal without requiring special tools would be particularly beneficial.

BRIEF DESCRIPTION OF THE INVENTION

Additional aspects and advantages of the invention will be set forth in part in the following description, or may be apparent from the description, or may be learned through practice of the invention.

In one exemplary embodiment, the present invention provides a washing appliance including a cabinet and a wash tub positioned in the cabinet and defining a wash chamber. A wash drum is rotatably mounted within the wash chamber and is configured for receiving articles for washing. An impeller is positioned in the wash drum. The impeller is rotational about a vertical axis and is configured for imparting motion to the articles during washing. The impeller may include a receptacle, a plurality of grooves extending along a circumferential direction about the receptacle, a plurality of notches with each notch connected with one of the plurality of grooves and extending along a vertical direction, and a plurality of access channels with each access channel connected with one of the plurality of grooves and extending along the vertical direction.

An agitator post can be configured for removable positioning in the receptacle of the impeller, the agitator post having a top end and a bottom end. The agitator post may include a plurality of agitator tabs proximate the bottom end that project along a radial direction and are configured for movement along the circumferential direction within the plurality of grooves and movement along the vertical direction within the plurality of notches and the plurality of access channels. A biasing element may be positioned between the impeller and agitator post when the agitator post is received in the receptacle, the biasing element configured for urging the agitator post upwardly along the vertical direction within the receptacle.

In another exemplary embodiment, the present invention may include a washing appliance. A wash drum may be rotatably mounted within a wash chamber and configured for receiving articles for washing. An impeller may be positioned in the wash drum, the impeller being rotational about a vertical axis and configured for imparting motion to the articles during washing. A receptacle may be centrally located on the impeller, the receptacle defining a recess. A plurality of access channels may be located within the recess and spaced apart along a circumferential direction. A plurality of notches may be located within the recess and spaced apart along a circumferential direction. A plurality of grooves may be located within the recess, each of the grooves extending longitudinally along a circumferential direction between one of notches and one of the access channels.

An agitator post can be removably positioned within the receptacle, the agitator post extending along the vertical axis between a top end and a bottom end. A plurality of agitator tabs may extend along a radial direction from the bottom end of the agitator post, the agitator tabs configured for sliding movement within the access channels, notches, and grooves.

A spring may be positioned between the impeller and the agitator post when the agitator post is in the receptacle, the spring configured to urge the agitator post upwardly along the vertical axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 7, an exemplary agitator post is shown in a receptacle of the exemplary impeller.

The use of the same or similar reference numbers in the figures denotes same or similar features unless the context indicates otherwise.

DETAILED DESCRIPTION OF THE INVENTION

Figure 1:
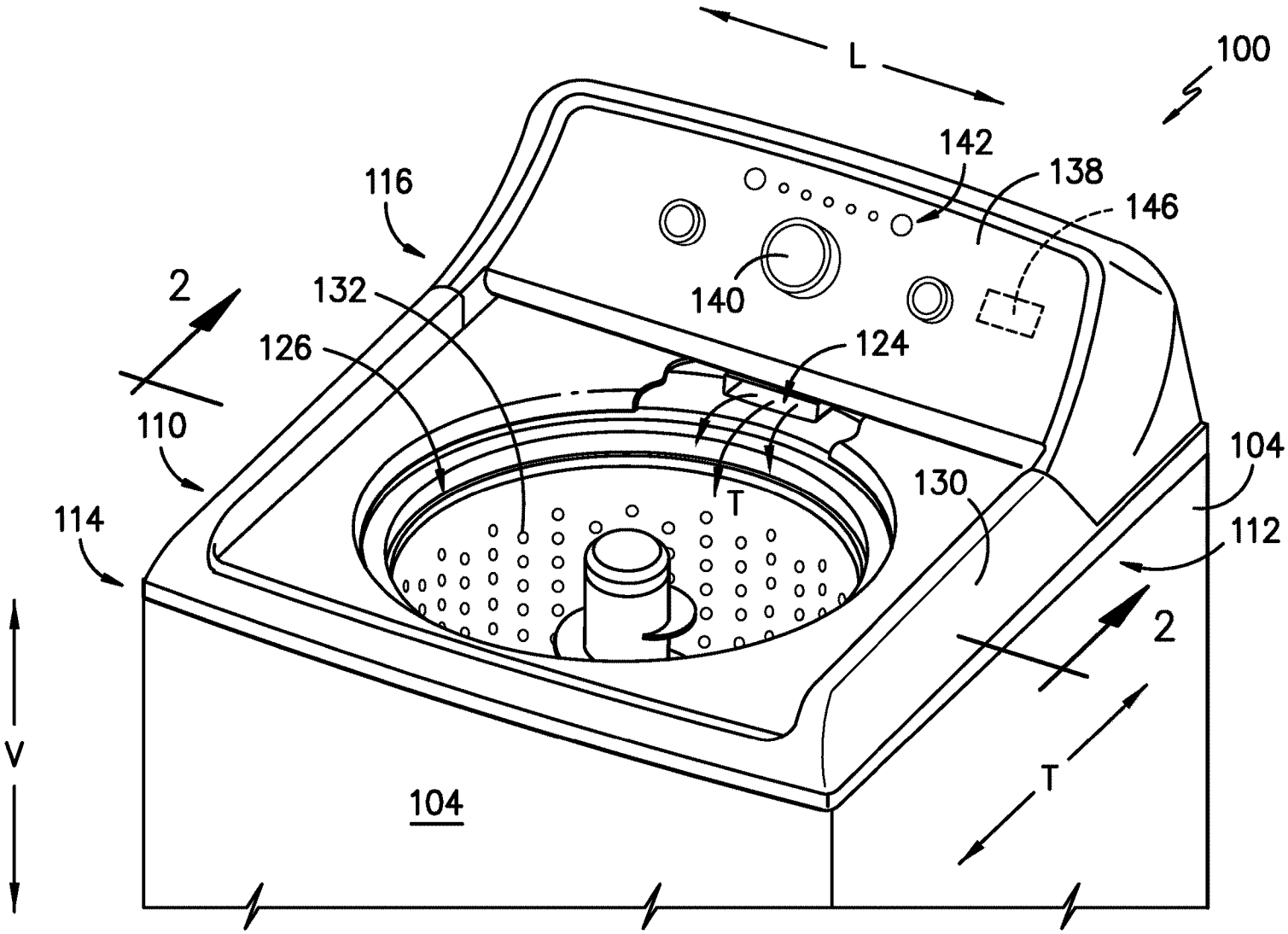
FIG. 1 provides a partial perspective view of an exemplary embodiment of a washing machine of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
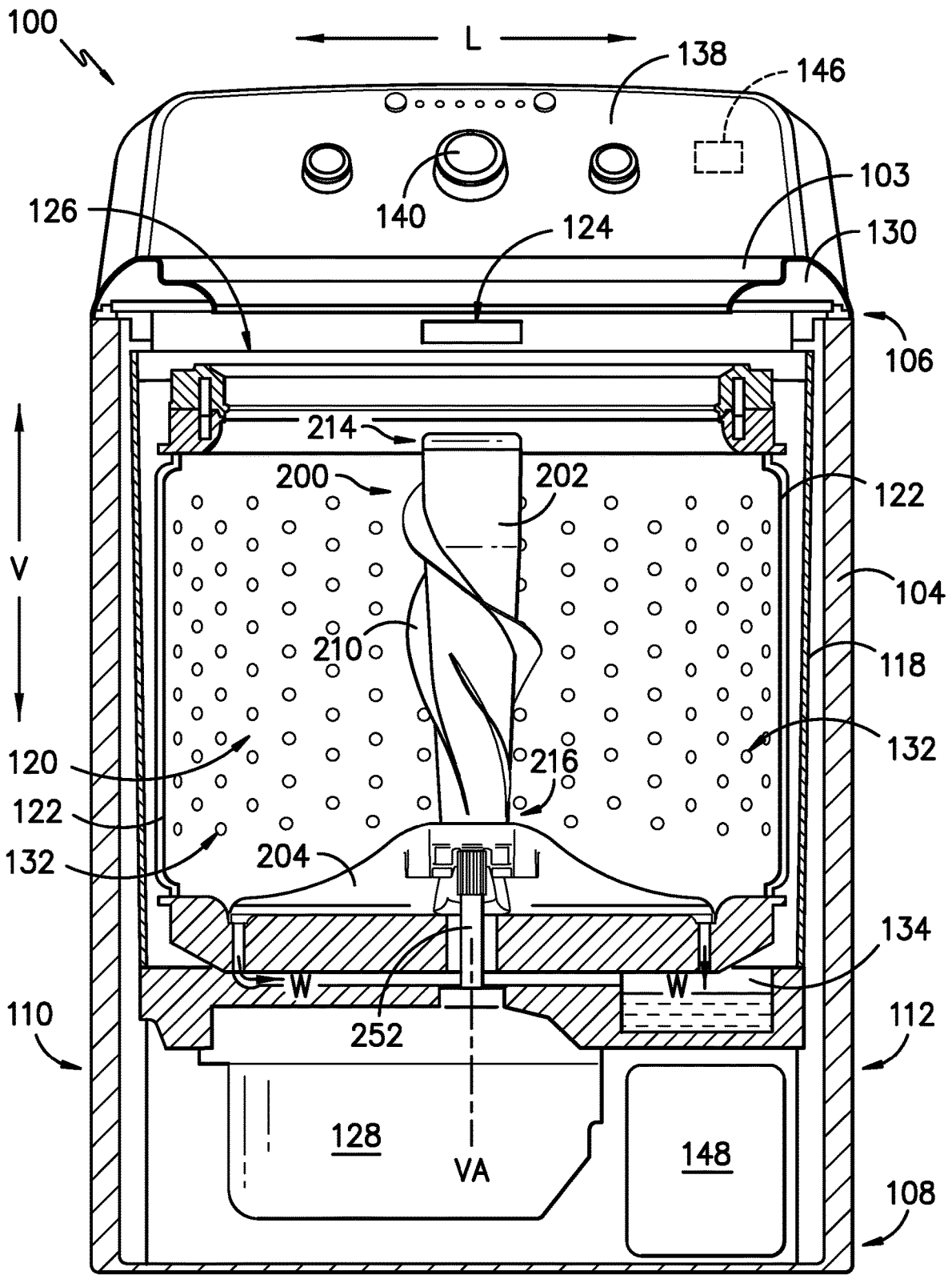
FIG. 2 provides a front cross-sectional view of the exemplary washing machine of FIG. 1.

FIGS. 1 and 2 illustrate an exemplary embodiment of a vertical axis washing appliance 100 of the present invention, which is also sometimes referred to as a top loading or vertical axis washing machine. In FIG. 1, a door 103 (shown in FIG. 2) has been removed for purposes of illustrating other features of the invention. Washing machine appliance 100 has a cabinet 104 that extends between a top portion 106 and a bottom portion 108 along the vertical direction V, between a first side (left) 110 and a second side (right) 112 along the lateral direction L, and between a front 114 and a rear 116 along the transverse direction T. The present invention is not limited to the particular vertical axis washing appliance 100 shown in the figures. Using the teachings disclosed herein, one or skill in the art will understand the other embodiments of a washing machine are also in the scope of the present invention.

As best shown in FIG. 2, a wash tub 118 is positioned within cabinet 102, defines a wash chamber 120, and is generally configured for retaining wash fluids during an operating cycle. A wash drum 122 is rotatably mounted within wash chamber 120 of wash tub 118. Washing machine appliance 100 further includes a dispenser 124 for dispensing wash fluid into wash tub 118. In addition, appliance 100 may include one or more additional dispensers for directing fluid into wash tub 118 and each dispenser may be separately controlled by one or more valves controlling flow to each dispenser independently of the others. The term "wash fluid" refers to a liquid used for washing and/or rinsing articles during an operating cycle and may include any combination of water, detergent, fabric softener, bleach, and other wash additives or treatments. As used herein, the term "cleaning cycle" includes a wash cycle, rinse cycle, spin cycle, or combinations thereof.

Wash drum 122 and cabinet 104 generally define an opening 126 (accessible through door 103) for receipt of articles for washing. Wash drum 122 rotates about a vertical axis of rotation VA (FIGS. 2 and 3) powered by motor assembly 128. According to the illustrated embodiment, the axis of rotation VA is substantially parallel to the vertical direction V. As used herein, terms of approximation, such as "approximately," "substantially," or "about," refer to being within a ten percent margin of error.

As illustrated, cabinet 104 of washing machine appliance 100 has a top panel 130. Top panel 130 defines an opening (FIG. 1) that coincides with opening 126 of wash tub 118 to permit a user access to wash drum 122. Door 103 is rotatably mounted to top panel 130 to permit selective access to opening 126. In particular, door 103 selectively rotates between a closed position and an open position. In the closed position, door 103 inhibits access to wash drum 122. Conversely, in the open position, a user can access wash drum 122. Although door 103 is illustrated as mounted to top panel 130, door 103 may alternatively be mounted to cabinet 104 or any other suitable support.

As best shown in FIG. 2, wash drum 122 further defines a plurality of perforations 132 to facilitate fluid communication between an interior of wash drum 122 and wash tub 118. In this regard, wash drum 122 is spaced apart from wash tub 118 to define a space for wash fluid to escape wash chamber 120. During a spin cycle, wash fluid within articles being washed (e.g., clothing) and within wash chamber 120 is urged through perforations 132 wherein it may collect in a sump 134 defined by wash tub 118. Washing machine appliance 100 further includes a pump assembly 148 (FIG. 2) that is located beneath wash tub 118 and wash drum 122 for gravity assisted flow when draining wash tub 118.

An exemplary article movement mechanism 200, including impeller 204 (FIGS. 2 and 3) and agitator post 202, is rotatably mounted within wash drum 122 to impart motion to articles and liquid in wash drum 122. More specifically, impeller 204 and agitator post 202 extend into wash drum 122 and assist agitation of articles disposed within wash drum 122 (as will be later described) during operation of washing appliance 100, e.g., to facilitate improved cleaning. For this exemplary embodiment, agitator post 202 includes one or more helical vanes 210 extending from the outer surface 212 of agitator post 202 and extending vertically between bottom end 216 and top end 214 thereof. Helical vanes 210 may be configured to assist the agitation of articles or support the overall desired motion thereof during a cleaning cycle. As will be understood by one of skill in the art using teachings disclosed herein, helical vanes 210 may have different shapes, thickness, and other features from what is depicted in the figures and may actually include multiples sets of overlapping or non-overlapping vanes.

In different embodiments, impeller 204 and agitator post 202 may rotate separately or together. Such rotations include a single action element (i.e., oscillatory only), a double action element (oscillatory movement at one end, single direction rotation at the other end) or a triple action element (oscillatory movement plus single direction rotation at one end, single direction rotation at the other end). Impeller 204, agitator post 202, and wash drum 122 are oriented to rotate about a vertical axis of rotation VA (which is substantially parallel to vertical direction V). For example, impeller 204 and/or agitator post 202 may rotate back and forth in alternate directions about vertical axis VA during a cleaning cycle. Additional description of the actions of impeller 204 and agitator post 202 are set forth below.

As stated, washing machine appliance 100 includes a motor assembly 128 in mechanical communication with wash drum 122 to selectively rotate wash drum 122 (e.g., during a wash cycle or a rinse cycle of washing machine appliance 100). In addition, motor assembly 128 may also be in mechanical communication with impeller 204 and agitator post 202. For example, impeller 204 may be connected with assembly 128 using a fastener 254 that attaches impeller 204 to a shaft 252 from assembly 128. Motor assembly 128 may be configured for selectively and independently rotating or oscillating wash drum 122, impeller 204, and/or agitator post 202 during various operating cycles of washing machine appliance 100.

Figure 3:
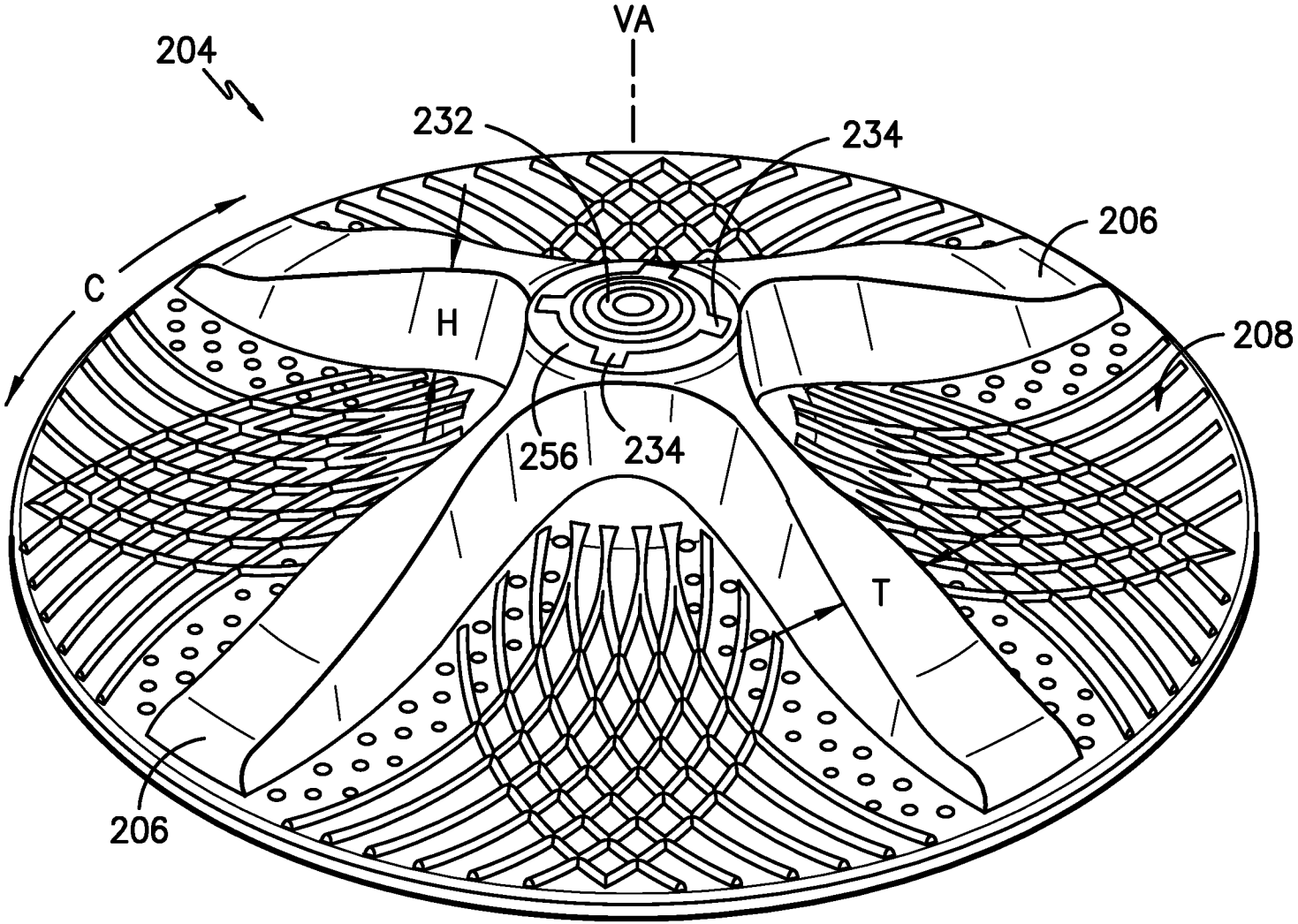
FIG. 3 provides a perspective view of an exemplary impeller used with an article movement mechanism of the present invention.
Figure 4:
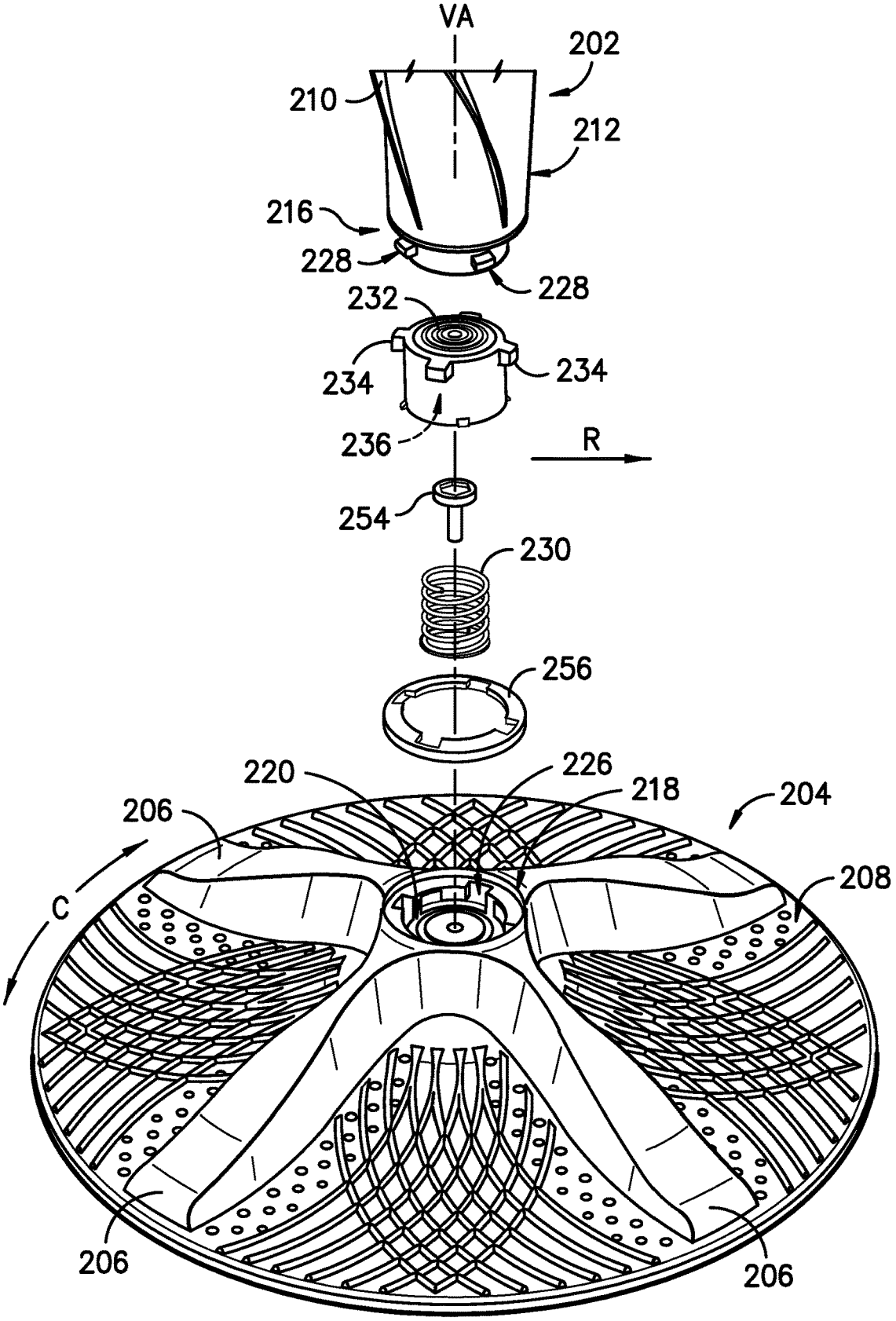
FIG. 4 provides an exploded view of an exemplary article movement mechanism of the invention included the impeller of FIG. 3.
Figure 5:
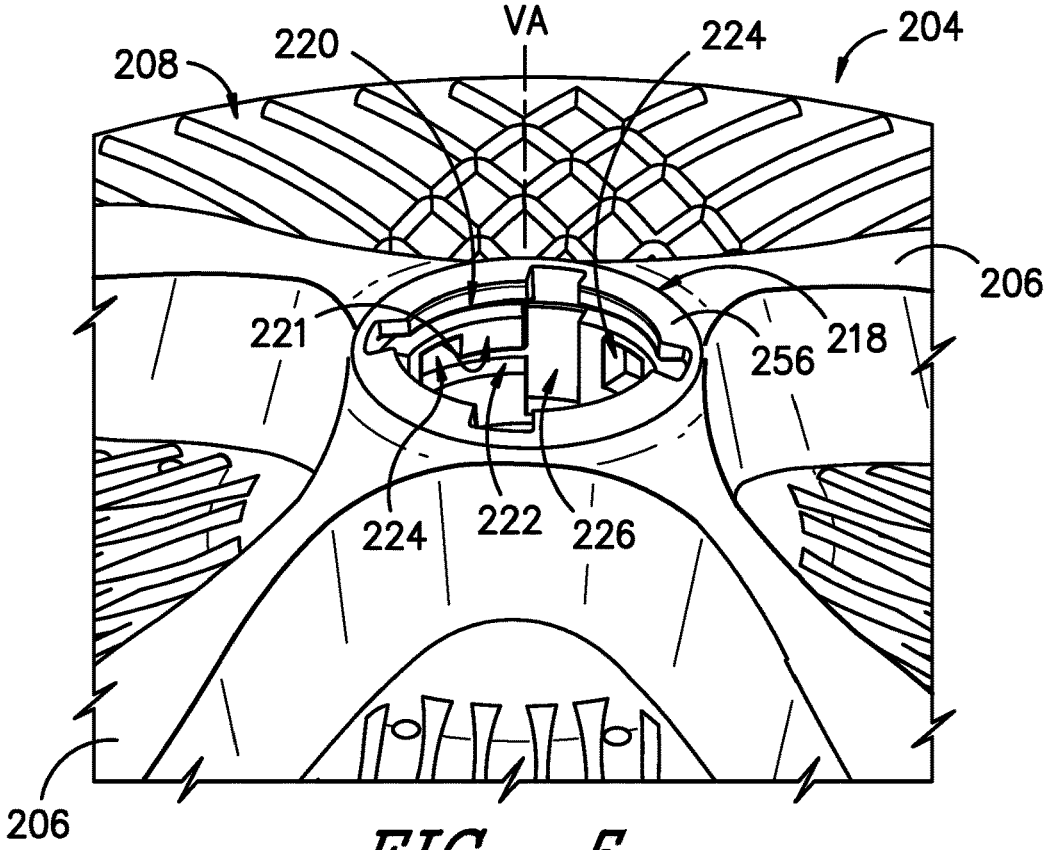
FIG. 5 is a close-up perspective view of the exemplary impeller of FIG. 3.
Figure 6:
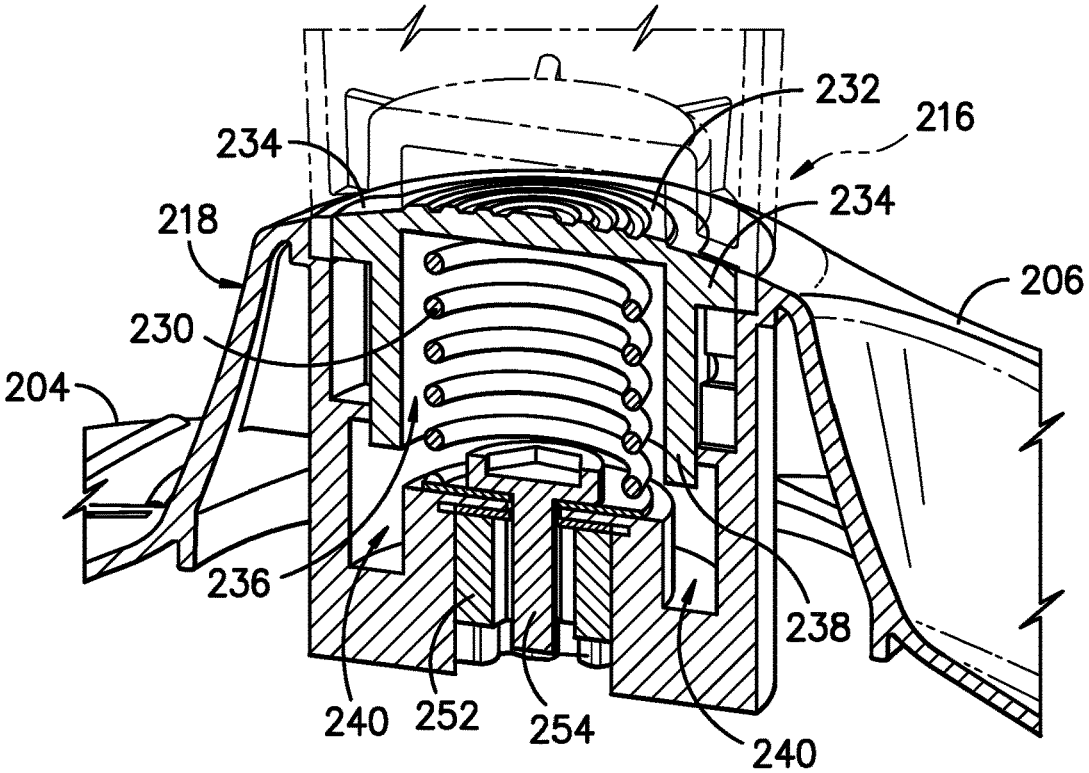
FIGS. 6 and 7 are cross-sectional views of a portion of the exemplary article movement mechanism of FIGS. 3 through 5.
Figure 7:
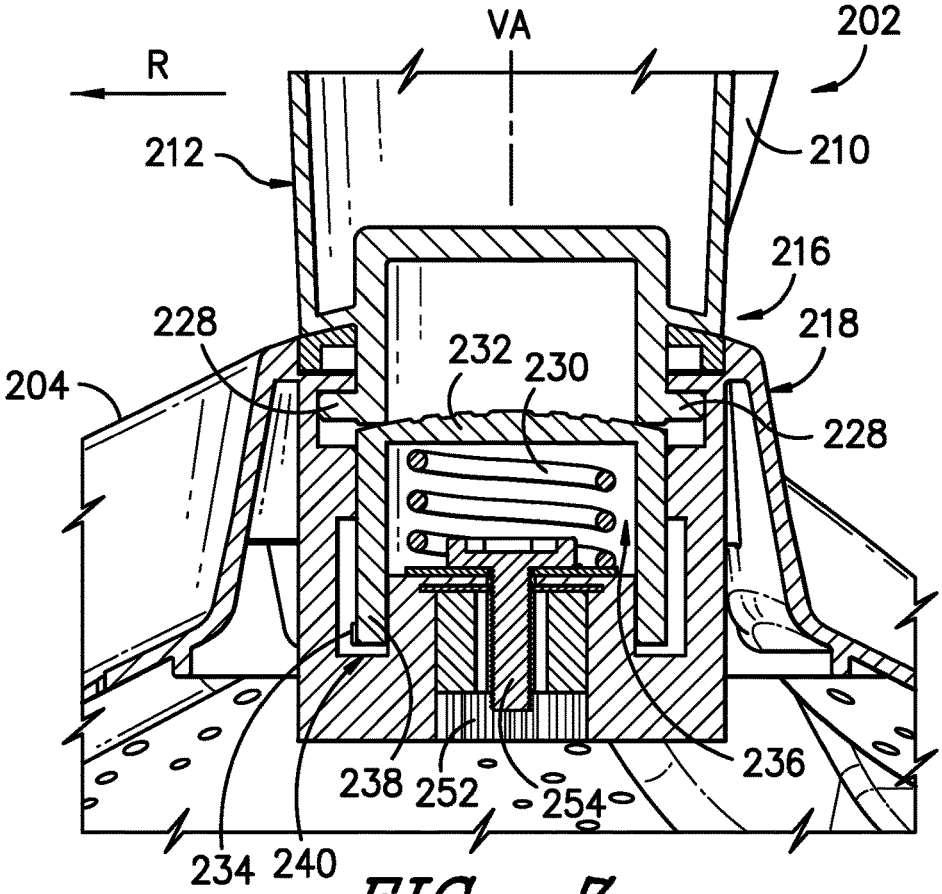
Figure 8:
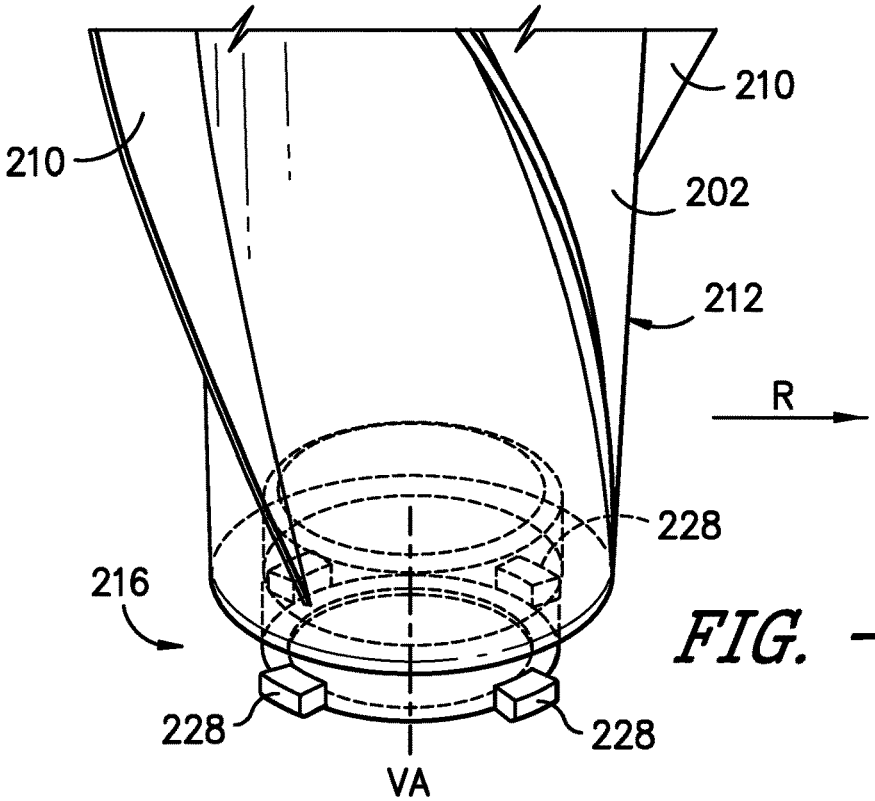
FIG. 8 is a partial perspective view of the bottom end of an exemplary agitator post of the present invention.
Figure 9:
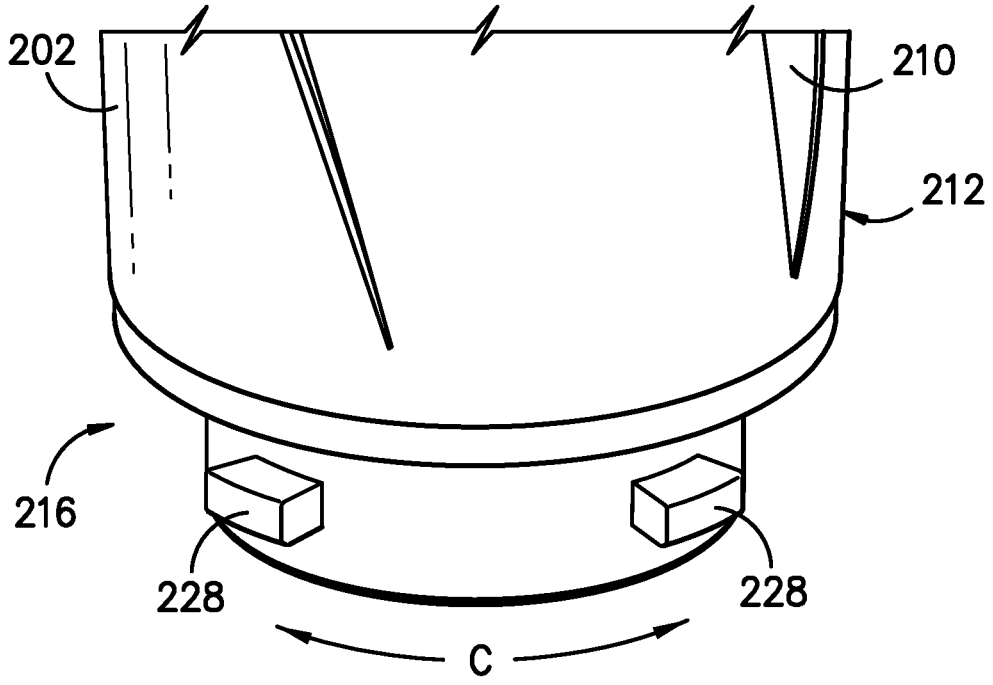
FIG. 9 is another partial perspective view of the exemplary bottom end.
Figure 10:
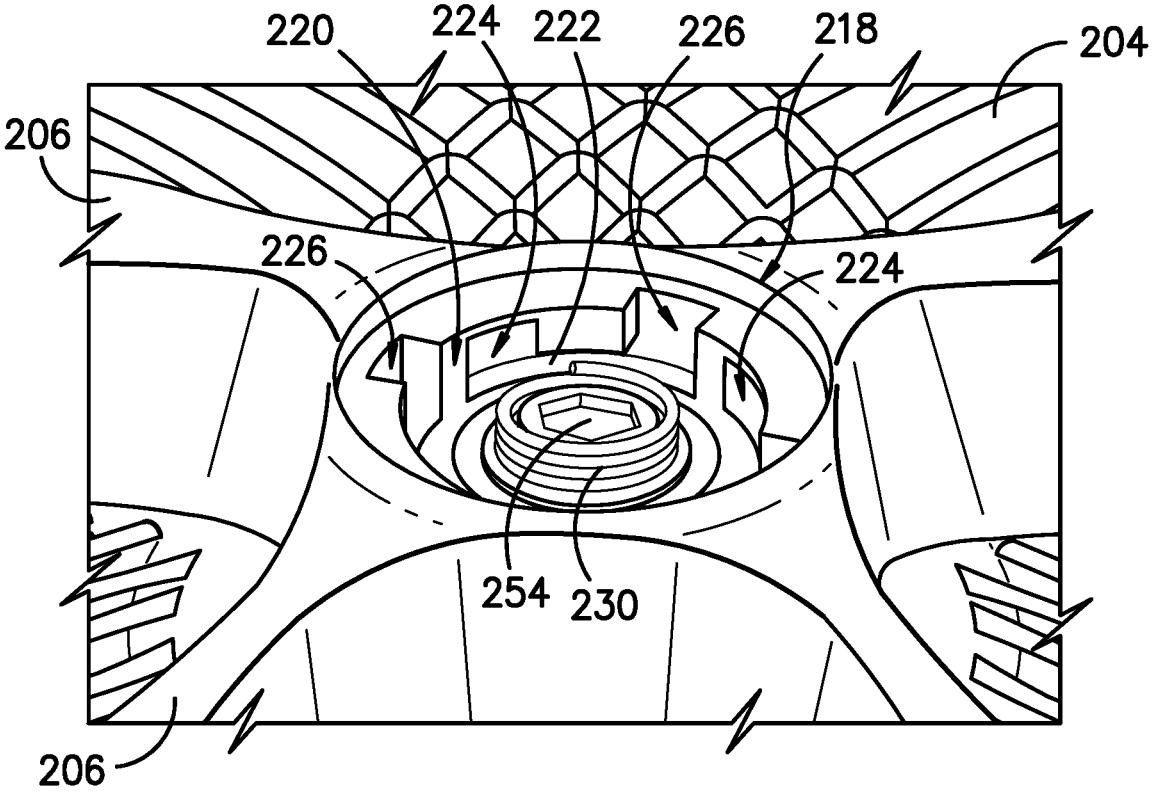
FIG. 10 is a close-up perspective view of another exemplary embodiment of an impeller of the present invention.
Figure 11:
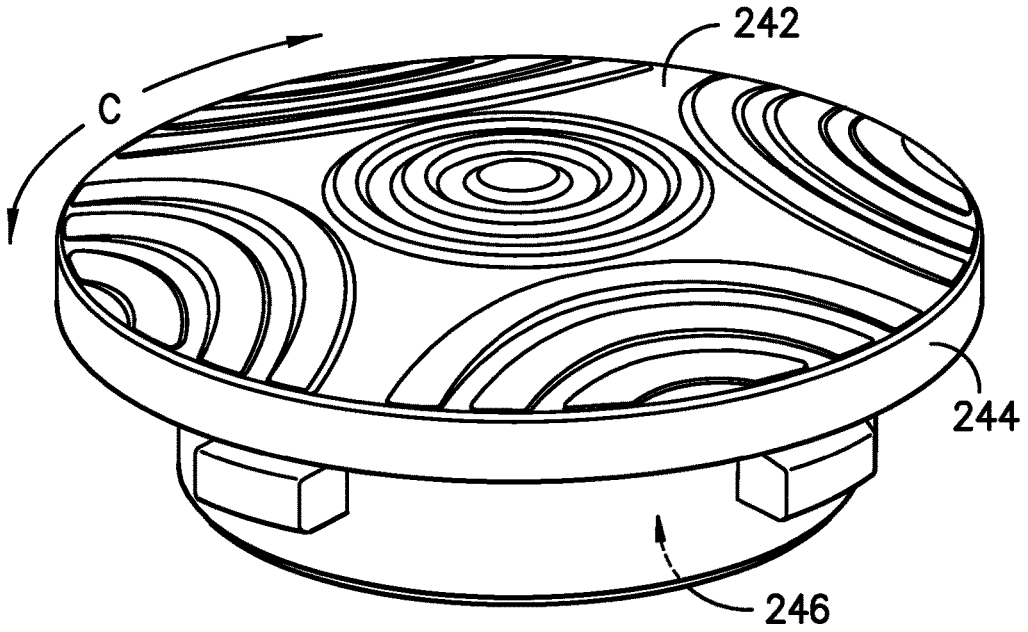
FIG. 11 is a perspective view of an exemplary embodiment of a removable cap.

Referring still to FIGS. 1 through 3, a control panel 138 with at least one input selector 140 (FIGS. 1 and 2) extends from top panel 130. Control panel 138 and input selector 140 collectively form a user interface input for operator selection of machine cycles and features of washing appliance 100. A display 142 of control panel 138 indicates selected features, operation mode, a countdown timer, and/or other items of interest to appliance users regarding operation.

Operation of washing machine appliance 100 is controlled by at least one controller or processing device 146 that is operatively coupled to control panel 138 for user manipulation to select washing machine cycles and features. In response to user manipulation of control panel 138, controller 146 operates the various components of washing machine appliance 100 to execute selected machine cycles and features. According to an exemplary embodiment, controller 146 may include a memory and microprocessor, such as a general or special purpose microprocessor operable to execute programming instructions or micro-control code associated with methods described herein. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 138 and other components of washing machine appliance 100 may be in communication with controller 146 via one or more signal lines or shared communication busses.

During operation of washing machine appliance 100, laundry items are loaded into wash drum 122 through opening 126, and washing operation is initiated through operator manipulation of input selector 140. Water, detergent and/or other fluid additives can be added to wash tub 118 and wash drum 122 through dispenser 124 and/or other dispensers as well. Controller 146 can operate one or more valves of washing appliance 100 to provide for filling wash tub 118 and wash drum 122 to the appropriate level for the amount of articles being washed and/or rinsed. By way of example for a wash mode, once wash drum 122 is properly filled with fluid, the contents of wash drum 122 can be agitated (e.g., with article movement mechanism 200 as discussed previously) for washing of laundry items in wash drum 122. The specific operation of wash appliance 100 by controller 146 will depend on various inputs including the cycle and other settings that may be selected by the user, the amount of article placed in wash chamber 120, and other variables as will be understood by one of skill in the art using the teachings disclosed herein.

By way of continuing example, after wash tub 118 is filled and the agitation phase of the wash cycle is completed, wash tub 118 and drum 122 can be drained, e.g., by drain pump assembly 148. Laundry articles can then be rinsed by again adding fluid to wash drum 122 and tub 118 again depending on the specifics of the cleaning cycle selected by a user. The impeller 204 and/or agitator post 202 may also provide agitation within wash drum 122. One or more spin cycles may also be used as part of the cleaning process. In particular, a spin cycle may be applied after the wash cycle and/or after the rinse cycle in order to wring wash fluid from the articles being washed. During a spin cycle, wash drum 122 is rotated at relatively high speeds to help wring fluid from the laundry articles through perforations 132. After articles disposed in wash drum 122 are cleaned and/or washed, the user can remove the articles from wash drum 122, e.g., by reaching into wash drum 122 through opening 126.

As will now be further described, the exemplary article movement mechanism 200 allows desired movements to be imparted to articles in wash drum 122 during a cleaning cycle. These movements, which can include combinations of movement along vertical direction V and radial direction R, assist in cleaning articles while in the wash fluid. One exemplary pattern of movement will now be described. Using the teachings disclosed herein, one of skill in the art will understand that other patterns or paths of fluid and/or article movement in drum 122 may be used as well in other embodiments of the invention.

For example, after articles to be cleaned and fluid are loaded into cylindrical wash drum 122, rotations of impeller 204 may impart an inverse toroidal motion to articles in wash drum 122 during a cleaning cycle. In such motion, articles may move vertically upward from impeller 204 along agitator post 202 and then radially outward (the radial direction is indicated by arrow R in FIG. 3, which is a direction perpendicular to vertical axis VA) at the top of an article load towards the cylindrical portion 123 of wash drum 122.

The articles then move vertically downward towards impeller 204 and radially inward along the bottom of an article load towards agitator post 202 where the cycle repeats under the influence of components such as impeller 204. Accordingly, during a cleaning cycle, this inverse toroidal motion results generally in a turnover of articles in wash drum 122. As used herein, "inverse toroidal motion" or "inverse toroidal movement" does not refer to the specific movement necessarily of any individual article but to the overall movement of articles in wash drum 122 instead. A variety of factors create the inverse toroidal motion the occurs in wash drum 122 including, for example, the relative amounts of fluid and articles present in drum 122, the shape of wash drum 122, the configuration and movements of agitator post 202, the configuration and movements of impeller 204, and other factors as well.

With reference to FIG. 3, for this exemplary embodiment of mechanism 200, impeller 204 includes a plurality of radial lobes 206 spaced apart along circumferential direction C. Each lobe 206 has thickness T as measured along the circumferential direction C that varies moving along radial direction R. For the exemplary embodiment shown, thickness T narrows and then widens moving along radial direction R and away from agitator post 202. Each lobe 206 also has a height H above impeller base 208 along axial direction A that also varies along radial direction R. For the exemplary embodiment shown, height H gradually decreases moving along radial direction R and away from agitator post 202. Impeller 204 as depicted in FIGS. 2 and 3 is provided by way of example only. Other shapes and configurations may be used as well.

As noted, the configuration of impeller 204 assists in creating the desired movement of fluid and/or articles within wash drum 122. Article movement mechanism 200 also includes an agitator post 202 which may assist in providing or supporting the desired movement. In addition, using features as will also be described, agitator post 202 can be readily installed or removed by a user of appliance 100 without the use of special tools. Removal of agitator post 202 allows more volume within wash drum 122 for the receipt of articles and/or fluid. At the same time, agitator post 202 can be readily installed as may be needed for a particular movement of articles in drum 122 or as may be based on e.g., user preference. An exemplary embodiment of agitator post 202 is set forth in the figures and will now be further described.

Referring to FIGS. 3 through 9 and FIG. 19, for this exemplary embodiment, agitator post 202 is removably positioned in a receptacle 218 supported by impeller 204. Receptacle 218 is centrally located on impeller 204 and may be an integral part of impeller 204 or could be a discrete component added to impeller 204. Receptacle 218 defines a recess 220 (FIGS. 4 and 5) into which the bottom end 216 of agitator post 202 can be removably inserted through removable collar 256. The connection between agitator post 202 and impeller 204, which will be further described, allows for the transfer of torque to agitator post 202 during a cleaning cycle while also allowing a user to readily remove or replace agitator post 202.

Receptacle 218 includes an interior surface 221 that extends circumferentially about recess 220 and includes multiples features for selectively securing or releasing agitator post 202. These features are configured to receive a plurality of agitator tabs 228 positioned proximate to bottom end 216 of agitator post 202. Agitator tabs 228 project along radial direction R and are configured for movement along circumferential direction C and vertical direction V within multiple features provided by receptacle 218. The features within receptacle 218 may vary in different embodiments of the invention.

For the exemplary embodiment of FIGS. 3 through 9 and FIG. 19, receptacle 218 includes a plurality of grooves 222 that extend along a circumferential direction C about receptacle 218. A plurality of access channels 226 are spaced apart along circumferential direction C. Each access channel 226 is connected with one of the grooves 222 at a first end 262 of such groove 222. A plurality of notches 224 are spaced apart along circumferential direction C. Each notch 224 is connected with one of the grooves 222 at a second end 264 of such groove 222. Accordingly, each groove extends longitudinally along circumferential direction C between a notch 224 and an access channel 226.

Each access channel 226 extends along vertical direction V, which is parallel to vertical axis VA. Each access channel 226 is open at a top end 258 and extends vertically to a closed end 260. For this exemplary embodiment, closed end 260 is positioned below channel 226. Each notch 224 extends vertically upward from a respective groove 222.

As stated, at bottom end 216, agitator post 202 includes a plurality of agitator tabs 228 that project outwardly along radial direction R and are spaced apart along circumferential direction C. Agitator tabs 228 have height along vertical direction V and a width along circumferential direction C that allows for sliding movement within access channels 226, circumferential grooves 222, and notches 224. The alignment and number of agitator tabs 228 matches a corresponding alignment and number of access channels 226, circumferential grooves 222, and notches 224.

For this exemplary embodiment, a cap 232 is positioned within the recess 220 of receptacle 218. Cap 232 is movable along vertical direction V between an up position shown in FIGS. 3 and 6 and a down position shown in FIG. 7. Similar to agitator tabs 228, cap 232 includes a plurality of cap tabs 234 that project outwardly along radial direction R. Cap tabs 234 have a width along circumferential direction C that allows for sliding movement along vertical direction V within access channels 226 between the up position and the down position.

Cap 232 defines a cap recess 236 within a cylindrically-shaped wall 238. A biasing element or spring 230 is positioned in cap recess 236. As such, biasing element 230 is positioned between impeller 204 and agitator post 202 when agitator post 202 is in receptacle 218. The compression of biasing element 230 causes it to apply a force that urges agitator post 202 upwardly along vertical direction V or vertical axis VA when in receptacle 218.

For the exemplary embodiment of FIGS. 3 through 9 and FIG. 19, a user can install agitator post 202 into receptacle 218 by vertically aligning agitator tabs 228 with access channels 226. Once aligned, agitator post 202 can be moved downwardly along vertical axis VA, which results in bottom end 216 pressing upon cap 232. As cap 232 moves downwardly, cap tabs 234 slide downwardly in access channels 226 until reaching closed end 260. Cylindrically-shaped wall 238 is received into a circumferentially-extending slot 240 defined by receptacle 218. At the same time, agitator tabs 228 move into access channels 226 and move downwardly along vertical axis VA. Upon reaching the height of grooves 222, the user can rotate agitator post 202, which causes agitator tabs 228 to move from first end 262 to second end 264. Upon reaching second end 264, the user can release agitator post 202, which allows biasing element 230 to urge agitator post 202 upwardly. Agitator tabs 228 will move upwardly along vertical axis VA until received into notches 224. This secures the position of agitator post 202 and allows torque from impeller 204 to be transferred to agitator post 202.

The user can remove agitator post 202 by simply reversing the movement just described for installation. Upon removal, biasing element 230 will return cap 232 to the up position, keeping recess 220 of receptacle 218 closed as shown in FIG. 3. As such, this embodiment of article movement mechanism 200 allows washing appliance 100 to be used with or without agitator post 202. When agitator post 202 is not present, cap 232 precludes articles from migrating into recess 220 while also providing improved aesthetics.

Figure 20:
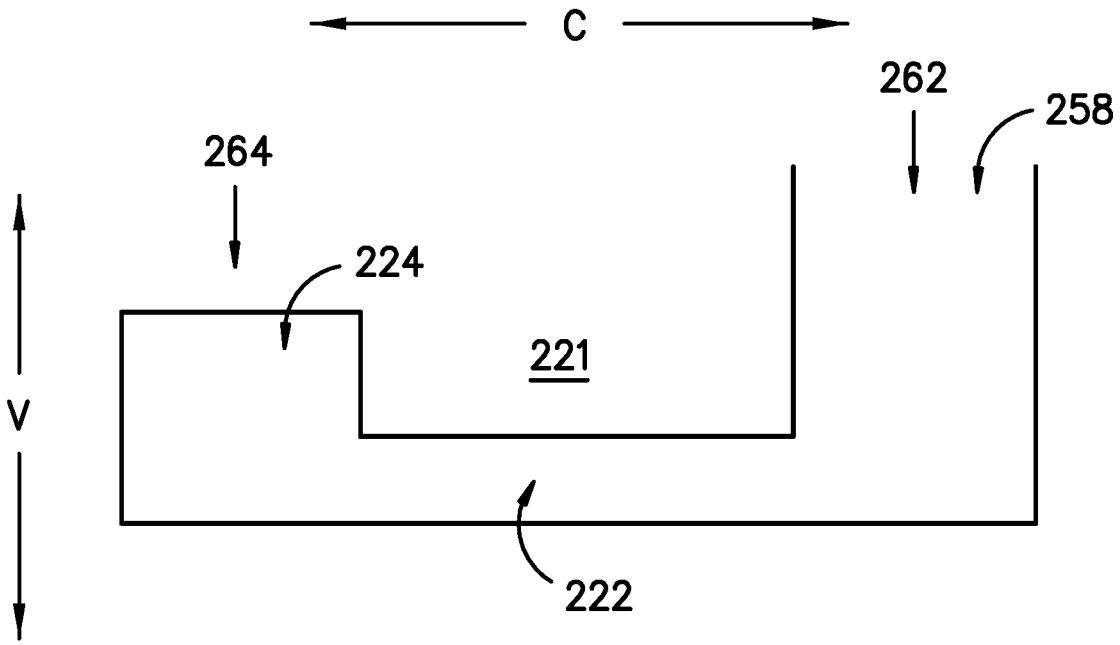
FIG. 20 is a schematic view of features provided by another exemplary receptacle as may be used for securing or releasing an agitator post.

Another exemplary embodiment of the invention is shown in FIGS. 10 through 14 and FIG. 20. This embodiment may use the same agitator post 202 with tabs 228 as previously described. Similarly, for this exemplary embodiment, agitator post 202 is also removably positioned in a receptacle 218 supported by impeller 204, and the connection between agitator post 202 and impeller 204 similarly allows for the transfer of torque to agitator post 202 during a cleaning cycle while also allowing a user to readily remove or replace agitator post 202. Receptacle 218 again includes multiples features on interior surface 221 for selectively securing or releasing agitator post 202. While these features are configured to receive agitator tabs 228 and allow for movement along circumferential direction C and vertical direction V, as shown in FIG. 20, such features differ somewhat from the previously described embodiment.

More particularly, in this embodiment, receptacle 218 includes a plurality of grooves 222 that extend along a circumferential direction C about receptacle 218 (FIG. 20). A plurality of access channels 226 are spaced apart along circumferential direction C. Each access channel 226 is connected with one of the grooves 222 at a first end 262 of such groove 222. A plurality of notches 224 are spaced apart along circumferential direction C. Each notch 224 is connected with one of the grooves 222 at a second end 264 of such groove 222. Each notch 224 extends vertically upward from a respective groove 222. Each access channel 226 extends along vertical direction V, which is parallel to vertical axis VA. Each access channel 226 is open at a top end 258 and extends vertically to a groove 222—but does not extend vertically below channel 226.

As with the previous embodiments, agitator tabs 228 have height along vertical direction V and a width along circumferential direction C that allows for sliding movement within access channels 226, circumferential grooves 222, and notches 224. The alignment and number of agitator tabs 228 matches a corresponding alignment and number of access channels 226, circumferential grooves 222, and notches 224.

Figure 14:
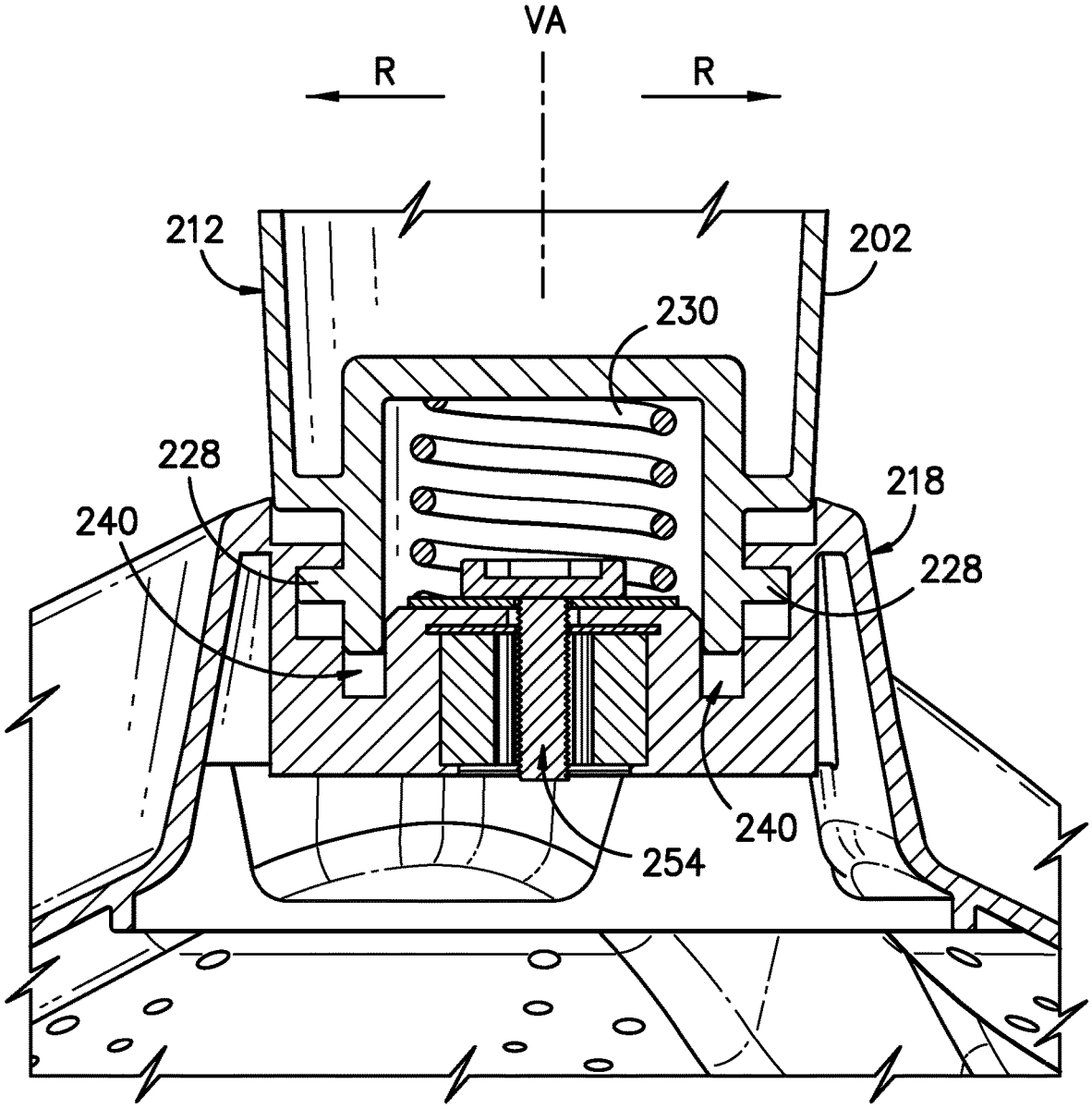
FIG. 14 is close-up, cross-sectional view of the exemplary embodiment of the impeller in FIG. 10 with the exemplary agitator post of FIGS. 8 and 9 installed therein.
Figure 15:
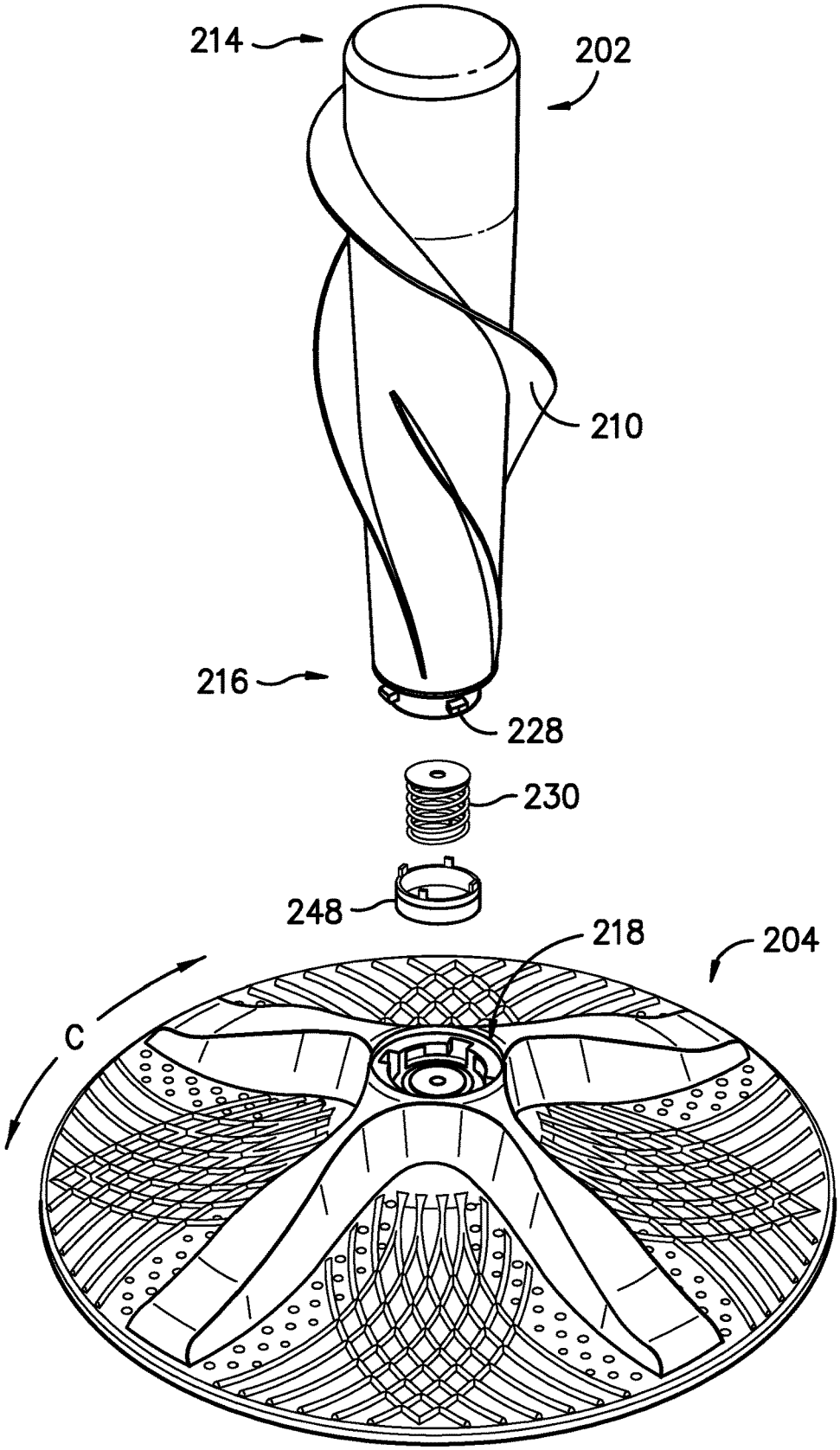
FIG. 15 is an exploded perspective view of another exemplary article movement mechanism of the present invention.

The embodiment of FIGS. 10 through 14 and FIG. 20 does not include cap 232 within recess 220. Instead, a user installs agitator post 202 into receptacle 218 by vertically aligning agitator tabs 228 with access channels 226. Once aligned, agitator post 202 is moved downwardly along vertical axis VA, which results in bottom end 216 making direct contact with biasing element or spring 230 (FIG. 14). As agitator tabs 228 move downwardly along vertical direction V within access channels 226, tabs 228 eventually reach grooves 222. The user can then rotate agitator post 202, which causes agitator tabs 228 to move from first end 262 to second end 264.

Upon reaching second end 264, the user can release agitator post 202, which allows biasing element 230 to urge agitator post 202 upwardly. Agitator tabs 228 will move upwardly along vertical direction V until received into notches 224. This secures the position of agitator post 202 and allows torque from impeller 204 to be transferred to agitator post 202. The user can remove agitator post 202 by simply reversing the movement just described for installation. Biasing element 230 will urge agitator post 202 upwardly as tabs 228 move upwardly along access channels 226 so that agitator post 202 may be removed from receptacle 218.

Figure 12:
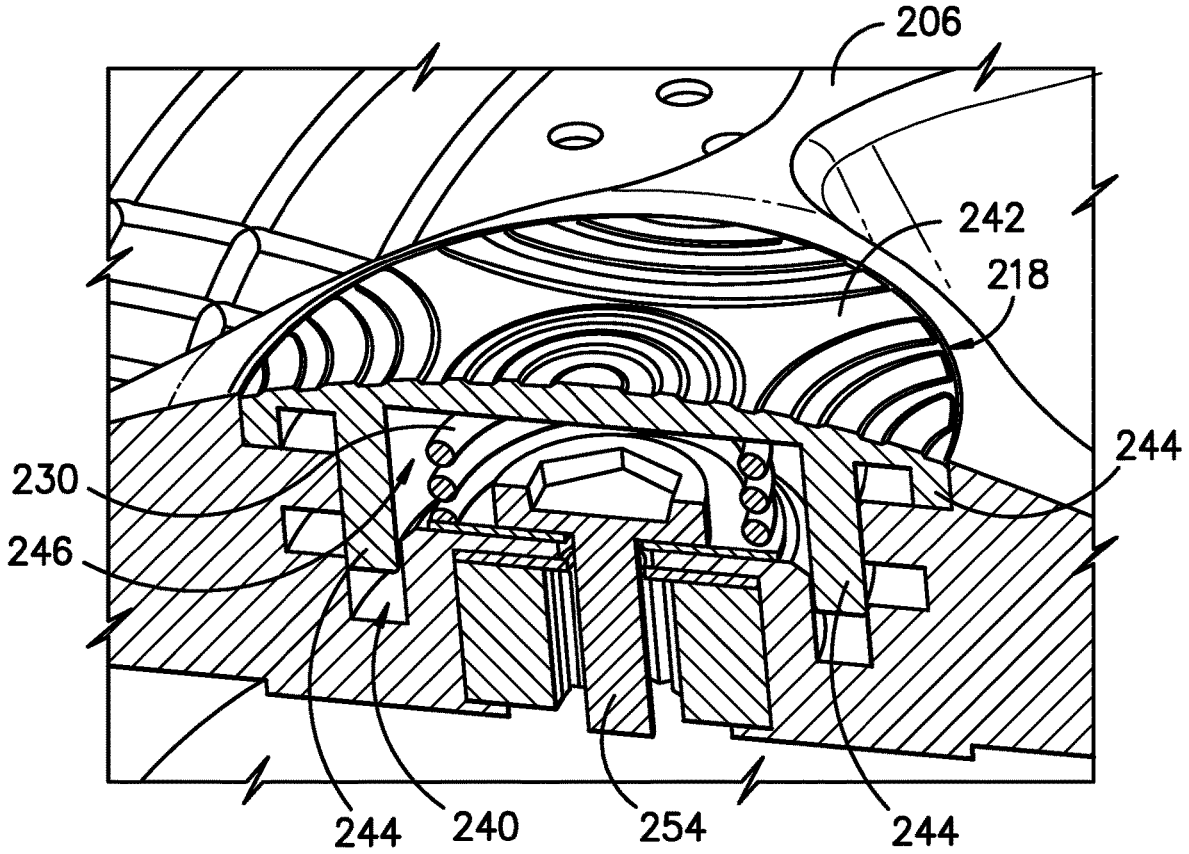
FIG. 12 is a close-up perspective view of the exemplary cap of FIG. 11 received in a recess of the exemplary impeller of FIG. 10.
Figure 13:
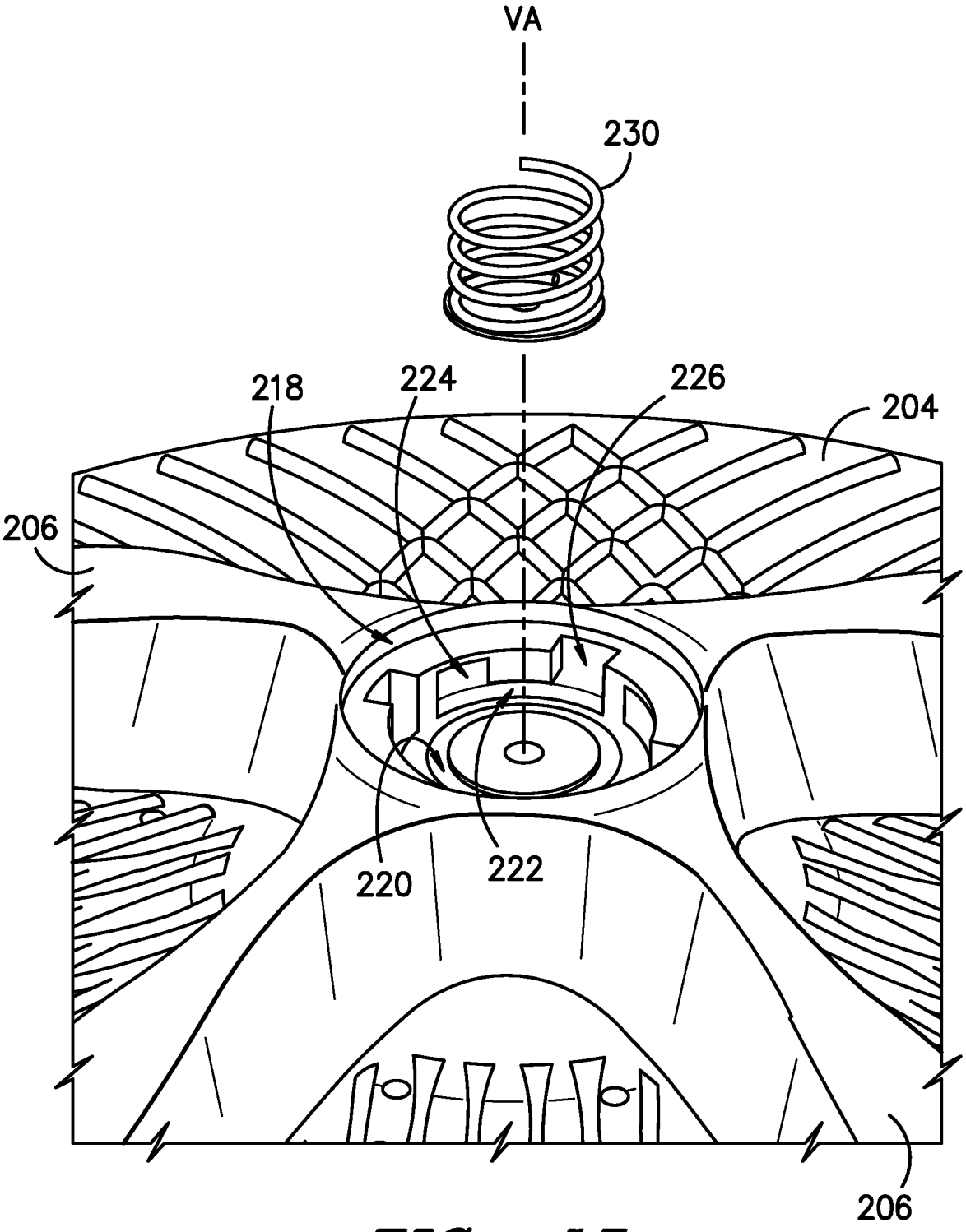
FIG. 13 is an exploded view of an exemplary biasing element and the exemplary impeller of FIG. 10.

Upon removal of agitator post 202, the user can place a removable cap 242 (FIG. 11) into receptacle 218 (FIG. 12). Removable cap 242 includes a cylindrically-shaped wall 244 that is received into circumferentially-extending slot 240. A peripheral lip 245 helps cover recess 220 and limit further movement of removable cap 242 downward along vertical direction V. A recess 246 in cap 242 receives spring 230 (FIG. 12). As such, this embodiment of article movement mechanism 200 also allows washing appliance 100 to be used with or without agitator post 202. When agitator post 202 is not present, removable cap 242 can be used to preclude articles from migrating into recess 220 while also providing improved aesthetics.

For previously described embodiments, biasing element 230 is positioned in recess 220 between impeller 204 and agitator post 202. However, in still another exemplary embodiment of the invention depicted in FIGS. 15 through 18, biasing element 230 may be contained within agitator post 202. This embodiment may still use the access channels 226, circumferential grooves 222, and notches 224 as described for the embodiment of FIGS. 10 through 14 and FIG. 20.

More particularly, for the embodiment of FIGS. 15 through 19, receptacle 218 includes a plurality of grooves 222, access channels 226, and notches 224 as previously described in reference to FIG. 20. Agitator post 202 again includes agitator tabs 228 (FIG. 15) having a height along vertical direction V and a width along circumferential direction C that allows for sliding movement within access channels 226, circumferential grooves 222, and notches 224. The alignment and number of agitator tabs 228 matches a corresponding alignment and number of access channels 226, circumferential grooves 222, and notches 224.

Figure 16:
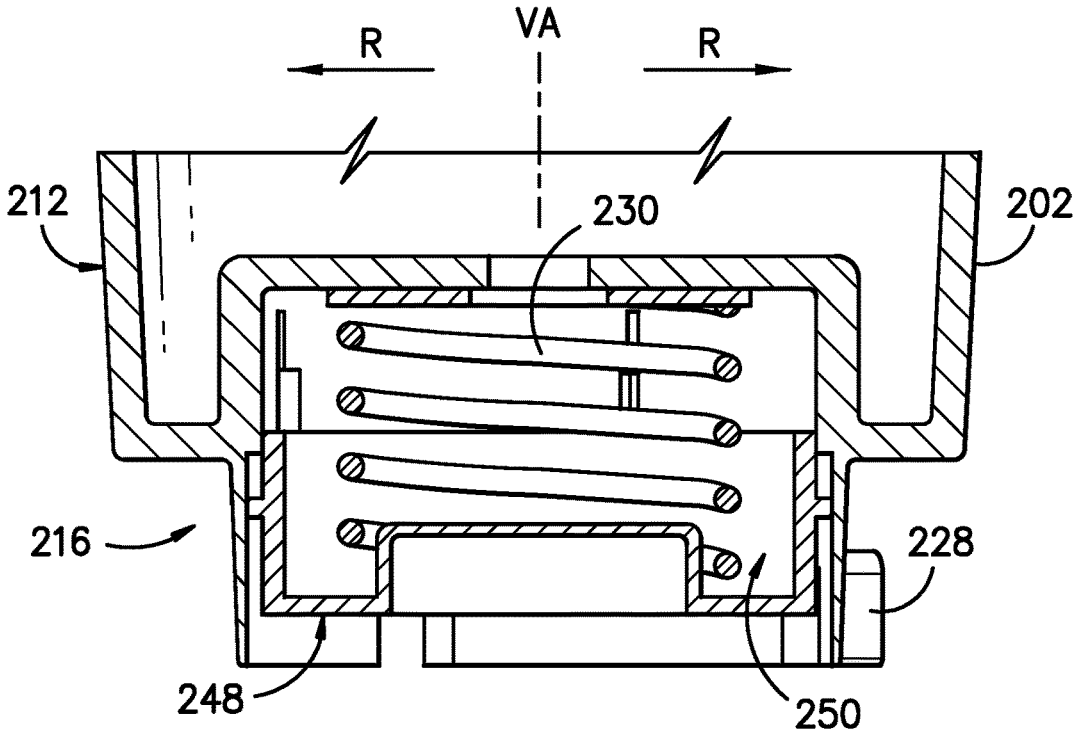
FIG. 16 is a cross-sectional view of the bottom end of the exemplary agitator post depicted in FIG. 15.
Figure 17:
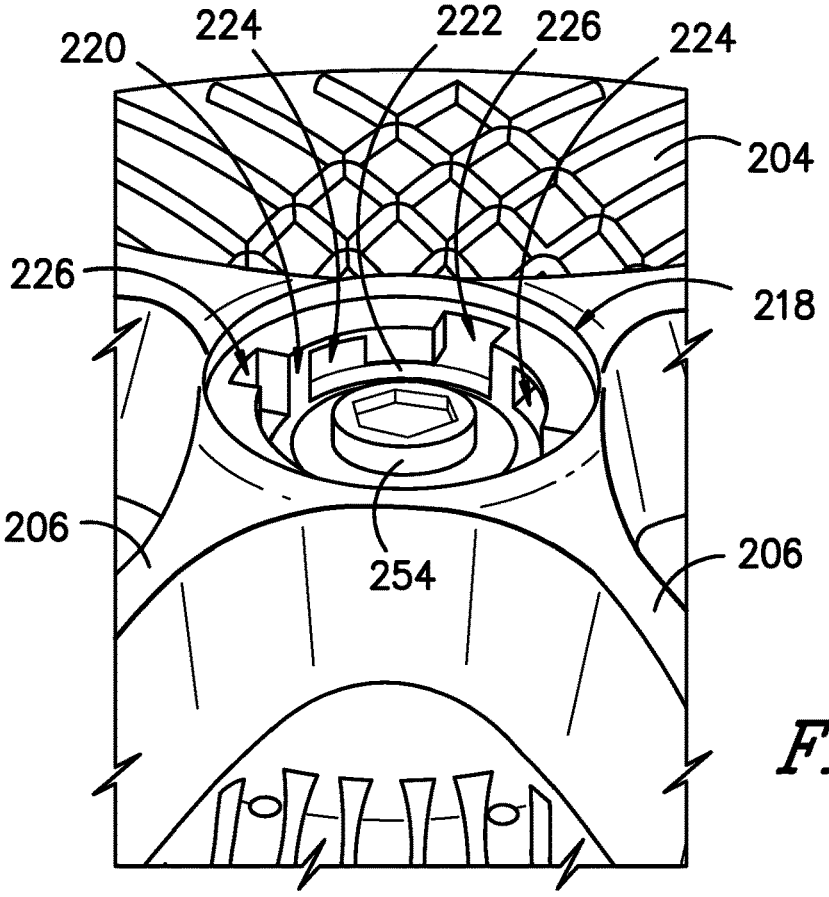
FIG. 17 is a close-up perspective view of the exemplary impeller depicted in FIG. 15.
Figure 18:
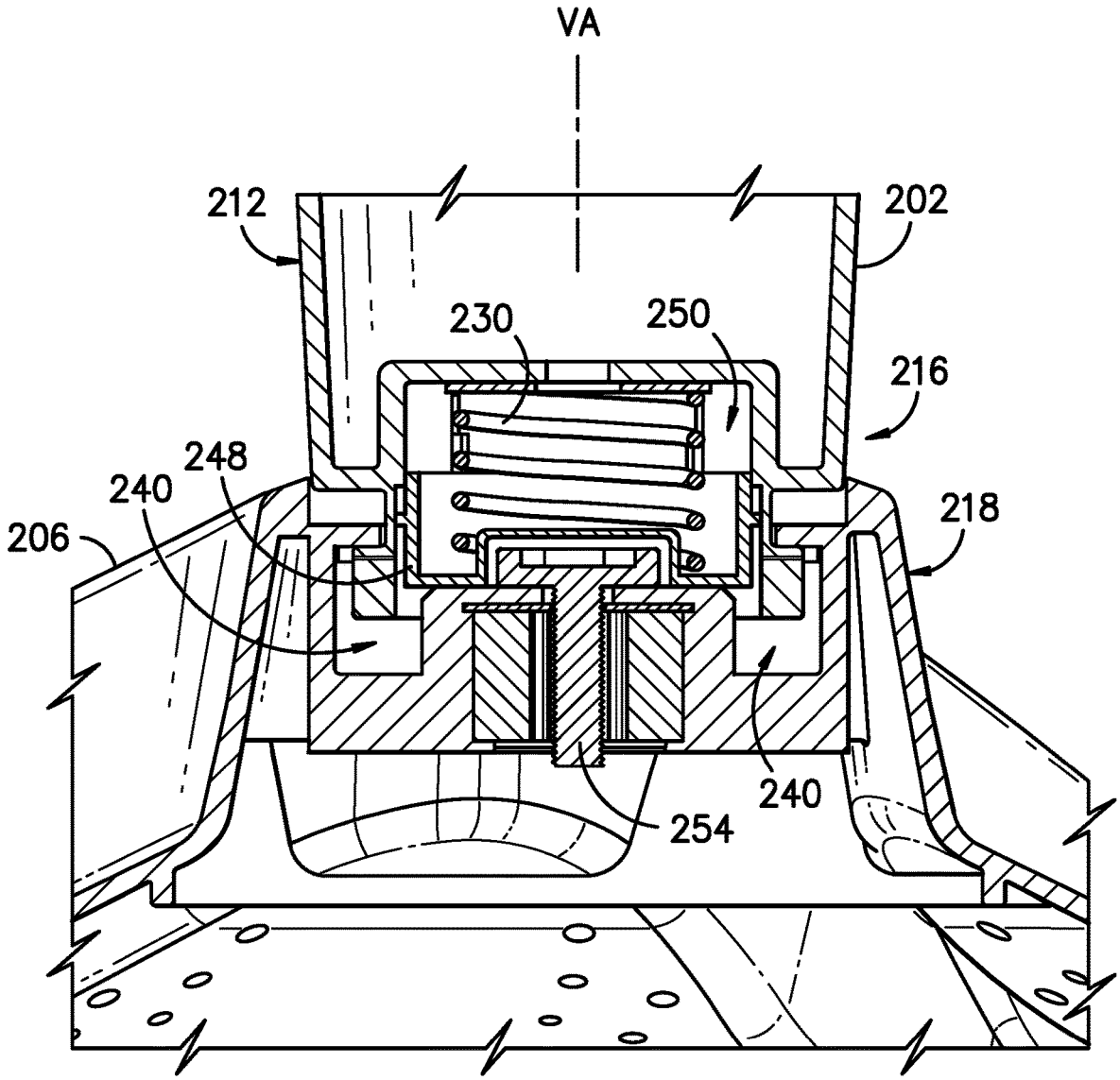
FIG. 18 is a close-up, cross-sectional view of the exemplary embodiment of the impeller in FIG. 15 with the exemplary agitator post of FIGS. 15 and 16 installed therein.
Figure 19:
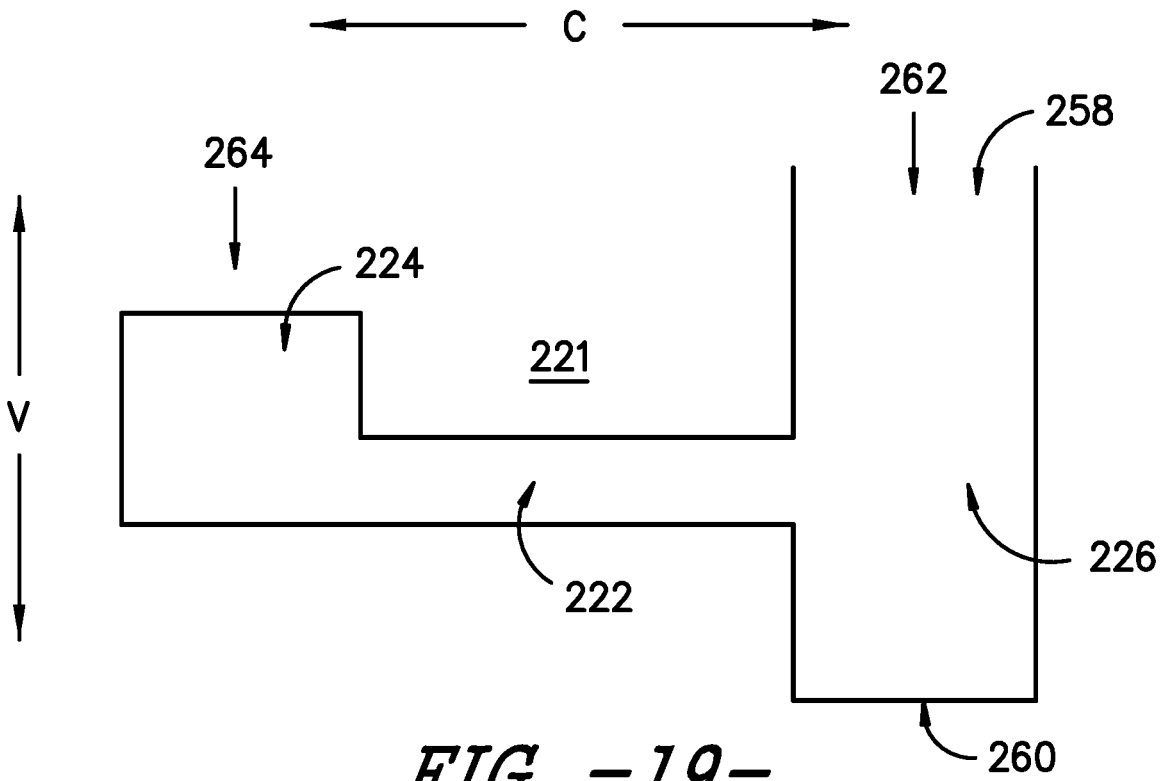
FIG. 19 is a schematic view of features provided by an exemplary receptacle as may be used for securing or releasing an agitator post.

The biasing element or spring 230 is located in a chamber 250 shown in FIG. 16. Chamber 250 is formed by bottom end 216 of agitator post 202 and a retainer 248. In order to allow for compression of spring 230, retainer 248 is movable along vertical direction V relative to bottom end 216.

A user can install agitator post 202 into receptacle 218 by vertically aligning agitator tabs 228 within access channels 226. Once aligned, agitator post 202 is moved downwardly along vertical axis VA, which results in retainer 248 contacting receptacle 218 and compressing spring 230. As agitator tabs 228 move downwardly along vertical direction V within access channels 226, tabs 228 eventually reach grooves 222. The user can then rotate agitator post 202, which causes agitator tabs 228 to move from first end 262 to second end 264.

Upon reaching second end 264, the user can release agitator post 202, which allows biasing element 230 to urge agitator post 202 upwardly. Agitator tabs 228 will move upwardly along vertical direction V until received into notches 224. This secures the position of agitator post 202 and allows torque from impeller 204 to be transferred to agitator post 202. The user can remove agitator post 202 by simply reversing the movement just described for installation. Spring 230 will urge agitator post 202 upwardly as tabs 228 move upwardly along access channels 226 so that agitator post 202 may be removed from receptacle 218. Upon removal of agitator post 202, the user can place removable cap 242 into receptacle 218 as previously described with reference to FIGS. 11 and 12. As such, as with previous embodiments, this embodiment of article movement mechanism 200 allows also washing appliance 100 to be used with or without agitator post 202. When agitator post 202 is not present, removable cap 242 can be used to preclude articles from migrating into recess 220 while also providing improved aesthetics.

A different number of tabs, access channels, notches, and grooves may be used from that shown in the figures. Although shown as uniformly spaced along circumferential direction C, different spacings may be used as well. Additionally, the present invention is not limited to the particular shape, size, or configuration of agitator post 202 or impeller 204—including lobes 206 and vane 210. While the embodiments shown in the figures would use a clockwise rotation (as viewed downwardly along vertical direction V) to secure agitator post 202 and a counter-clockwise rotation to release it, the features within receptacle 218 may be readily rearranged to provide for an opposite operation to secure or release—as will be understood by one of skill in the art using the teachings disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, comprising:

a cabinet;

a wash tub positioned in the cabinet and defining a wash chamber;

a wash drum rotatably mounted within the wash chamber and configured for receiving articles for washing;

an impeller positioned in the wash drum, the impeller being rotational about a vertical axis and configured for imparting motion to the articles during washing, the impeller including a receptacle, a plurality of grooves extending along a circumferential direction about the receptacle;

a plurality of notches, each notch connected with one of the plurality of grooves and extending along a vertical direction;

a plurality of access channels, each access channel connected with one of the plurality of grooves and extending along the vertical direction;

an agitator post configured for removable positioning in the receptacle of the impeller, the agitator post having a top end and a bottom end, the agitator post including a plurality of agitator tabs proximate the bottom end that project along a radial direction and are configured for movement along the circumferential direction within the plurality of grooves and movement along the vertical direction within the plurality of notches and the plurality of access channels;

a biasing element positioned between the impeller and agitator post when the agitator post is received in the receptacle, the biasing element configured for urging the agitator post upwardly along the vertical direction within the receptacle.

2. The washing appliance of claim 1, further comprising a cap positioned with the receptacle and movable between an up position and a down position along the vertical direction within the access channels, the cap including a plurality of cap tabs projecting along a radial direction and movably received within the access channels.

3. The washing appliance of claim 2, wherein the cap defines a cap recess into which the biasing element is positioned.

4. The washing appliance of claim 2, wherein the cap includes a cylindrically-shaped wall, and wherein the receptacle defines a circumferentially extending slot configured for complementary receipt of the cylindrically-shaped wall when the agitator post is in the down position.

5. The washing appliance of claim 2, wherein each of the access channels extends along the vertical direction both above and below the plurality of grooves.

6. The washing appliance of claim 1, further comprising a removable cap for positioning in the receptacle when the agitator post is not present.

7. The washing appliance of claim 6, wherein the removable cap includes a peripheral lip that prevents downward movement of the removable cap along a vertical direction within the receptacle.

8. The washing appliance of claim 1, further comprising a retainer connected to the bottom end of the agitator post, the retainer movable along the vertical direction relative to the agitator post, the retainer and the agitator post defining a chamber in which the biasing element is positioned.

9. The washing appliance of claim 8, the biasing element comprising a compression spring.

10. A washing appliance, comprising:

a wash drum rotatably mounted within a wash chamber and configured for receiving articles for washing;

an impeller positioned in the wash drum, the impeller being rotational about a vertical axis and configured for imparting motion to the articles during washing;

a receptacle centrally located on the impeller, the receptacle defining a recess;

a plurality of access channels located within the recess and spaced apart along a circumferential direction;

a plurality of notches located within the recess and spaced apart along a circumferential direction; and a plurality of grooves located within the recess, each of the grooves extending longitudinally along a circumferential direction between one of notches and one of the access channels;

an agitator post removably positioned within the receptacle, the agitator post extending along the vertical axis between a top end and a bottom end;

a plurality of agitator tabs extending along a radial direction from the bottom end of the agitator post, the agitator tabs configured for sliding movement within the access channels, notches, and grooves; and a spring positioned between the impeller and the agitator post when the agitator post is in the receptacle, the spring configured to urge the agitator post upwardly along the vertical axis.

11. The washing appliance of claim 10, further comprising a movable cap positioned in the receptacle and depressible by the agitator post along the vertical axis between an up position and a down position, the removable cap including a plurality of cap tabs extending along a radial direction and spaced apart the circumferential direction, the cap tabs configured for sliding movement along the access channels.

12. The washing appliance of claim 11, wherein the movable cap defines a recess in which the spring is received.

13. The washing appliance of claim 11, wherein the movable cap includes a cylindrically-shaped wall, and wherein the receptacle defines a circumferentially extending slot configured for complementary receipt of the cylindrically-shaped wall when the agitator post is in the down position.

14. The washing appliance of claim 11, wherein each of the access channels extends along a vertical direction both above and below the plurality of grooves.

15. The washing appliance of claim 11, further comprising a removable cap for positioning in the receptacle when the agitator post is not present.

16. The washing appliance of claim 15, wherein the removable cap includes a peripheral lip that prevents movement of the removable cap along a vertical direction within the receptacle.

17. The washing appliance of claim 11, further comprising a retainer connected to the bottom end of the agitator post, the retainer movable along a vertical direction relative to the agitator post, the retainer and the agitator post defining a chamber in which the spring is positioned.

18. The washing appliance of claim 11, wherein the agitator post comprises a helical vane extending around the agitator post, and wherein the impeller defines a plurality of lobes configured for imparting motion to articles during a cleaning cycle of the washing appliance.

* * * * *